US005842633A

United States Patent [19]

Nurse

[11] Patent Number: 5,842,633

[45] Date of Patent: Dec. 1, 1998

[54] SLEEVE FOR BEVERAGE CUPS

[75] Inventor: Robert I. Nurse, Toronto, Canada

[73] Assignee: Ivex Corporation, Ontario, Canada

[21] Appl. No.: 823,162

[22] Filed: Mar. 25, 1997

[30] Foreign Application Priority Data

Mar. 26, 1996 [GB] United Kingdom ..... 9606288

[51] Int. Cl.[6] ..... B65D 5/42

[52] U.S. Cl. ..... 229/403; 220/737; 229/198.2

[58] Field of Search ..... 229/4.5, 104, 198.2, 229/400, 403; 220/737, 738, 739, 903, 441, 443; 217/3 FC; 294/31.2

[56] References Cited

U.S. PATENT DOCUMENTS

| | | | |
|---|---|---|---|
| 1,758,827 | 5/1930 | Dudley | 217/3 FC |
| 1,929,065 | 10/1933 | Hiatt | 217/3 FC |
| 2,154,985 | 4/1939 | Lower | 217/3 FC |
| 2,661,889 | 12/1953 | Phinney | 229/4.5 |
| 2,979,301 | 4/1961 | Reveal | 220/737 |
| 5,205,473 | 4/1993 | Coffin, Sr. | 229/403 |
| 5,209,367 | 5/1993 | Van Musscher et al. | 220/737 |
| 5,385,260 | 1/1995 | Gatcomb | 229/403 |
| 5,425,497 | 6/1995 | Sorensen | 220/738 |
| 5,454,484 | 10/1995 | Chelossi | 229/4.5 |

*Primary Examiner*—Gary E. Elkins
*Attorney, Agent, or Firm*—Shoemaker and Mattare, Ltd

[57] ABSTRACT

A sleeve is provided for a frusto-conical beverage cup, configured to fit around the outside of the cup, thus protecting the fingers of the user from excessive temperatures in the case of a hot drink, and to provide a measure of insulation for the contents of the cup. The sleeve is an arcuate band of flexible, single-face corrugated material with curved side walls, oppositely extending slots adjacent the ends of the band and tabs lying alongside the slots, the tabs projecting only part-way across the width of the band, to facilitate the setting up of the sleeve.

6 Claims, 1 Drawing Sheet

SLEEVE FOR BEVERAGE CUPS

This invention relates generally to containers used in the hot beverage industry, especially for hot drinks like coffee and tea, and has to do particularly with a sleeve adapted to be fitted on the outside of a hot beverage cup, in order to protect the user's fingers from excessive heat, and to provide additional insulation for the hot contents of the cup.

BACKGROUND OF THIS INVENTION

Disposable paperboard cups are routinely used in fast food and roadside restaurants to contain hot drinks "to go". Such cups are of standardized sizes, normally frusto-conical with an upwardly open top rim adapted to receive one of several standard sizes of plastic lid.

Because such cups have relatively thin walls, they can be literally too hot to handle, particularly when they contain coffee or tea at a temperature close to the boiling point of water. As a result, many dispensers of such hot drinks will "double-cup" the beverage, using two nested cups instead of a single cup.

Double-cupping is of course very wasteful and increases the burden on the environment, even though the practice does reduce the rate at which heat passes outwardly through the (double) wall of the cup.

Clearly there is a need for an item of some kind which can be applied to a single cup in order to protect the user's fingers from high temperatures, but which (being a throw-away item like the cup itself) represents a much smaller burden on the environment than does the extra cup used in the double-cupping process.

PRIOR ART

A significant prior art patent is U.S. Pat. No. 5,425,497, issued Jun. 20, 1995 to Sorensen. This prior patent discloses a cup holder in the form of an arcuate band with oppositely extending slots at the ends, the band being of a sheet material characterized by a plurality of discrete, spaced-apart, approximately hemispherically-shaped depressions covering substantially the entire surface of the band, thus creating a plurality of air gaps between the band and a cup around with the band is placed.

The Sorensen configuration suffers from several drawbacks, as explained below.

One drawback of Sorensen relates to the fact that the end tabs span the entire width of the band, thus requiring the band to be greatly distorted in order to "set it up" with the slots interlocking. Another disadvantage relates to the substantial expense of the sheet material being utilized. The presence of the recesses and protuberances require the band material to be greatly stressed during manufacture, resulting in increased cost.

GENERAL DESCRIPTION OF THIS INVENTION

Generally, in one embodiment, the present invention provides an arcuate band utilizing inexpensive single-face corrugated material, in which the parallel corrugations extend throughout the band but are disposed substantially radially with respect to the band over only a limited region thereof, for example the centre region.

Since the corrugations are parallel, there will be a tendency for the band to assume a cylindrical configuration rather that a frusto-conical configuration when it is being "set up". To overcome this tendency, the band disclosed and claimed herein is provided with spaced-apart crease lines extending substantially radially with respect to the band, at least in those regions where the corrugations do not extend radially with respect to the band.

To facilitate the setting up of the band, the tabs extend only part-way across the width of the band, and are rounded in outline in order to avoid "catching" or "snagging" the corrugated surface of the band.

An arcuate band of flexible, single-face corrugated material having a concavely curved first side wall and a convexly curved second side wall, the side walls being substantially concentric; a first end wall portion defining a) a first slot extending from the first side wall toward said second side wall, but terminating at a location spaced from said second side wall, and b) a first tab integral with the band and lying alongside the first slot, a second end wall portion defining c) a second slot extending from the second side wall toward said first side wall, but terminating at a location spaced from said first side wall, and d) a second tab integral with the band and lying alongside the second slot, said first tab having a rounded periphery and extending only part-way toward said first side wall, said second tab having a rounded periphery and extending only part-way toward said second side wall.

Further, this invention provides a sleeve for a frusto-conical beverage cup, the sleeve comprising an arcuate band of flexible sheet material, the band defining a substantially concavely curved first side wall and a substantially convexly curved second side wall; a first end wall commencing at an end of the first side wall and extending generally perpendicular to the first side wall and toward the second side wall; a first tab integral with the arcuate band adjacent the second side wall, said first tab projecting away from the arcuate band and toward said first side wall so as to define a first slot between the first tab and the adjacent first end wall; a second end wall commencing at the end of the second side wall which is remote from said first end wall, and extending generally perpendicular to the second side wall and toward the first side wall; a second tab integral with the arcuate band adjacent the first side wall, said second tab projecting away from the arcuate band and toward said second side wall so as to define a second slot between the second tab and the adjacent second end wall; each tab extending only part of the distance between the two side walls such that a space remains between the respective tab and a hypothetical extension of the side wall toward which it projects; whereby the arcuate band can be formed into a frusto-conical jacket by engaging the first and second slots, and then can be fitted around a standard frusto-conical cup, to protect a user of the cup from excessive temperatures in the case of a hot drink, and to provide a measure of insulation for a liquid in the cup.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
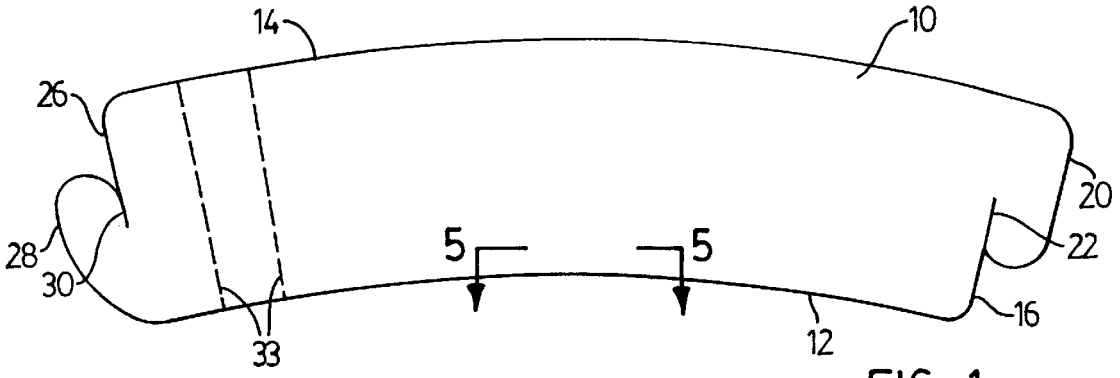
FIG. 1 is a plan view of a curved band of flexible material, which can be formed into a conical band and applied to a beverage cup.
Figure 5:
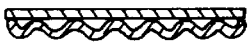
FIG. 5 is a partial sectional view of the band, taken at the line 5—5 in FIG. 1.

Attention is first directed to FIG. 1, which shows in plan view an arcuate band 10 (in the initial or "flat" condition)

preferable made from single-face corrugated material having the section shown in FIG. 5. The band 10 has a concavely curved first side wall 12 and a convexly curved second side wall 14. Conveniently, the side walls 12 and 14 are concentric, although concentricity is not a prerequisite.

The band 10 further exhibits a first end wall 16 commencing at the rightward end of the first side wall 12, and extending generally perpendicular thereto (i.e. approximately radially with respect to the curvature). The first end wall extends toward the second side wall 14, although it does not extend all the way to the second side wall. Instead, it ends at an intermediate point between the first side wall and the second side wall 14, allowing for a first tab 20 which is continuous with the first end wall 16 and is located adjacent the second side wall 14. As can be seen, the first tab 20 projects away from (rightwardly from) the arcuate band 10, and additionally projects downwardly in the direction of the first side wall 12, so as to define a first slot 22 between the first tab 20 and the adjacent first end wall 16.

A second end wall 26 commences at the end of the second side wall 14 which is remote from the first end wall 16 (i.e. at the leftward end as seen in FIG. 1). The second end wall 26 extends generally perpendicularly to the adjacent part of the second side wall 14 and toward the first side wall 12, but does not extend all the way to the side wall 12.

Instead, it terminates at an intermediate location between the walls 12 and 14. As is clearly visible, there is provided a second tab 28 which is continuous with the second end wall 26 adjacent the first side wall 12, the second tab 28 projecting (leftwardly) away from the arcuate band 10 and in the direction of the second side wall so as to define a second slot 30 between the second tab 28 and the adjacent second end wall 26. Each of the tabs 20 and 28 extends only part of the distance between the two side walls 12 and 14, such that a space remains between the respective tab 20, 28 and a hypothetical extension of the respective side wall toward which it projects.

This construction allows the arcuate band to be formed into a conical jacket by engaging the first and second slots 22 and 30, so that the conical jacket can be fitted around the exterior of a standard conical cup, to protect the fingers of the user from excessive temperatures in the case of a hot drink, and to provide a measure of insulation from the contents of the cup.

Figure 2:
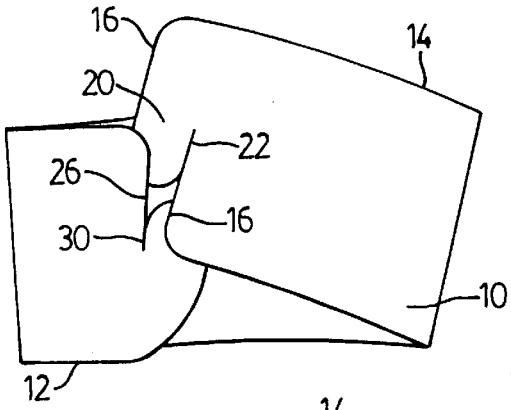
FIGS. 2, 3 and 4 are sequential side-elevational views of the arcuate band of FIG. 1, as it is formed into a conical sleeve.
Figure 3:
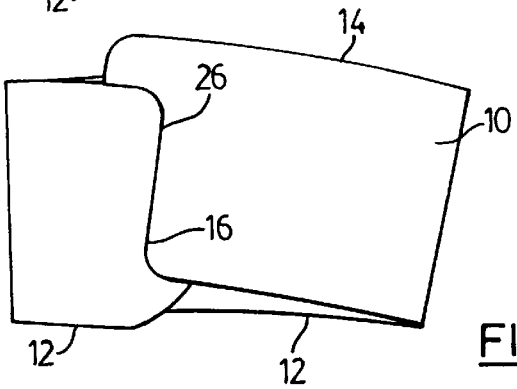
Figure 4:
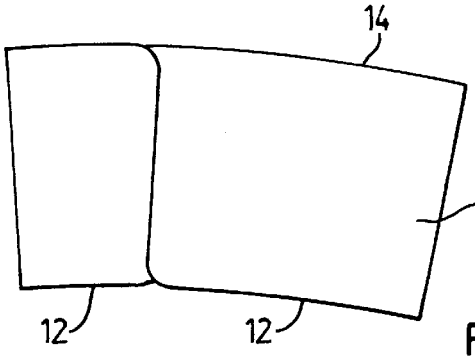

FIGS. 2, 3 and 4 are sequential views of the process by which the band 10 is formed into a frusto-conical jacket. Preferably, the resulting jacket has the corrugations toward the inside.

In the preferred embodiment illustrated in the drawings, both of the tabs 20 and 28 have rounded peripheries. In particular, the leftward tab 28 in FIG. 1 has a greater degree of roundedness than the tab 20 at the other end. This was found empirically to be advantageous in order to allow the tab to "slide" across the corrugations of the single-face corrugated material preferred for use in the present invention. Unless a certain degree of roundedness is applied, there is a tendency for the tab corners to wedge or become stuck against a groove defined by the corrugations, thus making it more difficult to assemble into the form shown in FIG. 4.

Returning to FIG. 1, it will be seen that, because all corrugations are parallel in the material as it comes from the manufacturer, it is not possible to arrange for the corrugations to be perpendicular to both curved side walls 12 and 14 over the full length of band 10. In the embodiment illustrated, the corrugations though extending throughout the band, are "radially" directed with respect to the curved side walls 12 and 14 only in the central region thereof. Toward the ends of the band 10, the corrugations are clearly set at an oblique angle to the local disposition of the side walls 12 and 14.

Because of this parallel relation of the corrugations, there is a tendency for the band to seek a cylindrical configuration when formed into a ring, rather than the required conical or frusto-conical configuration. In order to weaken the tendency to remain cylindrical, a preferred embodiment of this invention provides that crease lines be impressed into the material of the arcuate band 10 at short intervals over its entire length, with the crease lines extending substantially radially between the first and second side walls 12 and 14. In FIG. 1, the crease lines are identified by the numeral 33. It has been found that the provision of such crease lines helps to promote conical curvature when the band 10 is formed into a sleeve for use with a conical cup.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A sleeve for a frusto-conical beverage cup, comprising:

an arcuate band of flexible, single-face corrugated material having a concavely curved first side wall and a concavely curved second side wall, the side walls being substantially concentric; a first end wall portion defining a) a first slot extending from the first side wall toward said second side wall, but terminating at a location spaced from said second side wall, and b) a first tab integral with the band and lying alongside the first slot, a second end wall portion defining c) a second slot extending from the second side wall toward said first side wall, but terminating at a location spaced from said first side wall, and d) a second tab integral with the band and lying alongside the second slot, said first tab having a rounded periphery and extending only part-way toward said first side wall, said second tab having a rounded periphery and extending only part-way toward said second side wall.

2. The sleeve claimed in claim 1, in which the periphery of the second tab is more rounded than is the periphery of the first tab.

3. The sleeve claimed in claim 1, or 2, in which the corrugated material has parallel corrugations substantially throughout the sleeve, the corrugations forming a substantial right-angle with respect to the side walls only in a central region of the sleeve; the band having, at least in the end regions thereof, spaced-apart crease lines extending substantially radially with respect to the side walls, thereby to encourage the band to assume a frusto-conical configuration when formed into a closed sleeve.

4. A sleeve for a frusto-conical beverage cup, the sleeve comprising an arcuate band of flexible sheet material, the band defining a substantially concavely curved first side wall and a substantially convexly curved second side wall; a first end wall commencing at an end of the first side wall and extending generally perpendicular to the first side wall and toward the second side wall; a first tab integral with the arcuate band adjacent the second side wall, said first tab projecting away from the arcuate band and toward said first side wall so as to define a first slot between the first tab and the adjacent first end wall; a second end wall commencing at the end of the second side wall which is remote from said first end wall, and extending generally perpendicular to the second side wall and toward the first side wall; a second tab integral with the arcuate band adjacent the first side wall, said second tab projecting away from the arcuate band and toward said second side wall so as to define a second slot between the second tab and the adjacent second end wall; each tab extending only part of the distance between the two side walls such that a space remains between the respective tab and a hypothetical extension of the side wall toward which it projects; whereby the arcuate band can be formed into a frusto-conical jacket by engaging the first and second slots, and then can be fitted around a standard frusto-conical cup, to protect a user of the cup from excessive temperatures in the case of a hot drink, and to provide a measure of insulation for a liquid in the cup.

5. The sleeve claimed in claim 4, in which the sheet material is single-face corrugated material, in which both tabs have rounded peripheries, and in which the side walls are substantially concentric.

6. The sleeve claimed in claim 5, in which the corrugated material has parallel corrugations substantially throughout the sleeve, the corrugations forming a substantial right-angle to the side walls only in a central region of the sleeve; the band having, at least in its end regions, spaced-apart crease lines extending substantially radially with respect to the side walls, thereby to encourage the band to assume a frusto-conical configuration when formed into a closed sleeve.

* * * * *